US010090591B2

(12) United States Patent
Liu et al.

(10) Patent No.: US 10,090,591 B2
(45) Date of Patent: Oct. 2, 2018

(54) ANTENNA SYSTEM

(71) Applicant: ACCTON TECHNOLOGY CORPORATION, Hsinchu (TW)

(72) Inventors: I-Ru Liu, Taipei (TW); Yang-Te Fu, Taichung (TW); Chang-Cheng Liu, Hsinchu County (TW); Yi-Chang Chen, Taoyuan (TW); Yu-Fang Wei, Taoyuan (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 135 days.

(21) Appl. No.: 15/207,490

(22) Filed: Jul. 11, 2016

(65) Prior Publication Data

US 2017/0310014 A1 Oct. 26, 2017

(30) Foreign Application Priority Data

Apr. 20, 2016 (TW) ..... 105112305 A

(51) Int. Cl.
*H01Q 3/24* (2006.01)
*H01Q 21/06* (2006.01)
*H01Q 1/50* (2006.01)

(52) U.S. Cl.
CPC ..... *H01Q 3/24* (2013.01); *H01Q 1/50* (2013.01); *H01Q 21/061* (2013.01)

(58) Field of Classification Search
CPC .... H01Q 21/06; H01Q 21/061; H01Q 21/062; H01Q 21/064; H01Q 21/065; H01Q 21/067; H01Q 21/068; H01Q 21/08
See application file for complete search history.

(56) References Cited

U.S. PATENT DOCUMENTS

| | | | | |
|---|---|---|---|---|
| 7,652,632 | B2 | 1/2010 | Shtrom | |
| 7,880,683 | B2 | 2/2011 | Shtrom et al. | |
| 8,085,206 | B2 | 12/2011 | Shtrom | |
| 8,686,905 | B2 | 4/2014 | Shtrom | |
| 2004/0010076 | A1 | 1/2004 | Sugiyama | |
| 2009/0278746 | A1* | 11/2009 | Aurinsalo | H01Q 9/0435 343/700 MS |
| 2010/0164784 | A1* | 7/2010 | Longstaff | G01S 13/003 342/202 |
| 2016/0285161 | A1* | 9/2016 | Apaydin | H01Q 1/525 |

FOREIGN PATENT DOCUMENTS

| | | |
|---|---|---|
| TW | M413981 U | 10/2011 |
| TW | I491109 B | 7/2015 |

* cited by examiner

*Primary Examiner* — Daniel J Munoz
(74) *Attorney, Agent, or Firm* — CKC & Partners Co., Ltd.

(57) ABSTRACT

An antenna system comprises first and second support structures, and a plurality of first, second and third antenna elements. Each of the first and second support structures has four sides. Two adjacent sides are perpendicular to each other so that both the first and second support structures form a closed loop. The first support structure is disposed outside of and surrounds the second support structure. Some first antenna elements are disposed on two symmetric sides of the first support structure, and other first antenna elements are disposed on two symmetric sides of the second support structure. Some second antenna elements are disposed on another two symmetric sides of the first support structure, and the other first antenna elements are disposed on another two symmetric sides of the second support structure. The third antenna elements are disposed on the four sides of the second support structure.

9 Claims, 7 Drawing Sheets

100

100'

ANTENNA SYSTEM

RELATED APPLICATIONS

This application claims priority to Taiwanese Application Serial Number 105112305, filed Apr. 20, 2016, which is herein incorporated by reference.

BACKGROUND

Field of Invention

The present invention relates to an antenna system. More particularly, the present invention relates to an antenna system that can improve transmission efficiency.

Description of Related Art

With the rapid evolution of Internet connection technology, a diversity of network services have emerged, and this has created demand for communications products capable of connecting to the Internet. Various manufacturers continue to improve the performance and design of their communications products to enhance product competitiveness. Manufacturers of such communications products typically enhance product performance by improving the antenna system to achieve the purpose of improving efficiency and reducing size. However, any improvement of the antenna system must involve not only adjustment and control of the operating band, but also must take into consideration labor costs associated with manufacturing the antenna system.

Therefore, a major challenge in designing an antenna system relates to considering both normal operation and improving transmission efficiency.

SUMMARY

The present disclosure provides an antenna system. The antenna system comprises a first support structure, a second support structure, a plurality of first antenna elements, a plurality of second elements and a plurality of third antenna elements. Each of the first support structure and the second support structure has four sides. Two adjacent sides are perpendicular to each other so that both the first support structure and the second support structure are formed as closed quadrilateral loops. The second support structure is disposed outside the first support structure, and surrounds the first support structure. Some of the first antenna elements are disposed on two symmetric sides of the first support structure, and the other first antenna elements are disposed on two symmetric sides of the second support structure. Some of the second antenna elements are disposed on another two symmetric sides of the first support structure, and the other second antenna elements are disposed on another two symmetric sides of the second support structure. The third antenna elements are disposed on the four sides of the second support structure dispersively.

In conclusion, the antenna system of the present disclosure integrates the antenna elements on a support structure according to a specific arrangement. Therefore, this antenna system is easily integrated into a product. Moreover, the antenna system further comprises switches that are controlled by the transmission quality parameters so that the input and output antennas corresponding to each switch in the 4×4 or 2×2 multi-input multi-output (MIMO) antenna system have more selective diversity to improve transmission quality.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DETAILED DESCRIPTION

In order to make the description of the disclosure more detailed and comprehensive, reference will now be made in detail to the accompanying drawings and the following embodiments. However, the provided embodiments are not used to limit the ranges covered by the present disclosure. Moreover, the order of any steps described is not used to limit the execution sequence thereof. Any device capable of achieving an equivalent effect through rearrangement is also covered by the present disclosure.

The terminology used herein is for the purpose of describing particular embodiments only and is not intended to be limiting of the invention. As used herein, the singular forms "a," "an" and "the" are intended to include the plural forms as well, unless the context clearly indicates otherwise.

In this document, the term "coupled" may also be termed as "electrically coupled," and the term "connected" may be termed as "electrically connected." "Coupled" and "connected" may also be used to indicate that two or more elements cooperate or interact with each other.

Figure 1A:
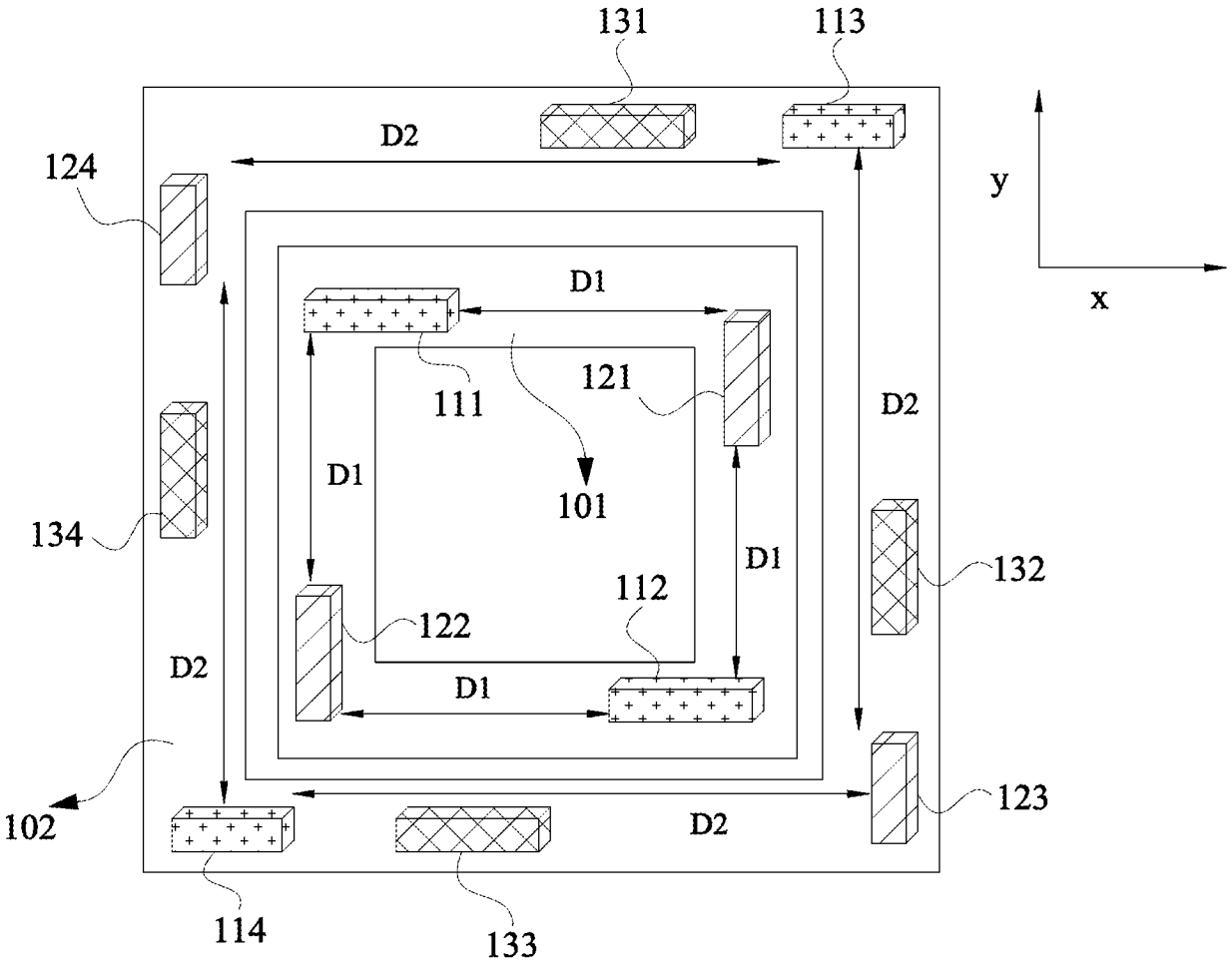
FIG. 1A is a schematic diagram of an antenna system according to an embodiment of the present disclosure.

FIG. 1A is a schematic diagram of an antenna system 100 according to an embodiment of the present disclosure. The antenna system comprises a first support structure 101, a second support structure 102, a plurality of first antenna elements 111-114, a plurality of second antenna elements 121-124 and a plurality of third antenna elements 131-134. In this embodiment, the antenna system 100 comprises two support structures and four first antenna elements, four second antenna elements and four third antenna elements. However, the number of support structures and the number of antenna elements may be adjusted according to actual requirements, and the present disclosure is not limited in this regard.

Each of the first support structure 101 and the second support structure 102 comprises four sides, and any two adjacent sides are perpendicular to each other. The second support structure 102 is disposed outwardly of the first support structure 101 and surrounds the first support structure 101. For example, each of the first support structure 101 and the second support structure 102 may be square-shaped. The length of the sides of the first support structure 101 is about 110 to 120 mm, and the length of the sides of the second support structure 102 is about 175 mm to 195 mm. However, the present invention is not limited in this regard. It is noted that, for configuration and installation considerations, the formation of the first support structure 101 and the second support structure 102 in the disclosure does not need to be intact. That is, the first support structure 101 and the second support structure 102 can have a tortuous appearance or a gap to bypass other elements, or can have a hole to facilitate the fixing of screws or for placing an element to be mounted. Moreover, the first support structure 101 and the second support structure 102 are not limited to be formed in a single molding configuration. The first support structure 101 and the second support structure 102 may be formed by a number of segments and be made by different materials. However, the present invention is not limited thereto.

Figure 1B:
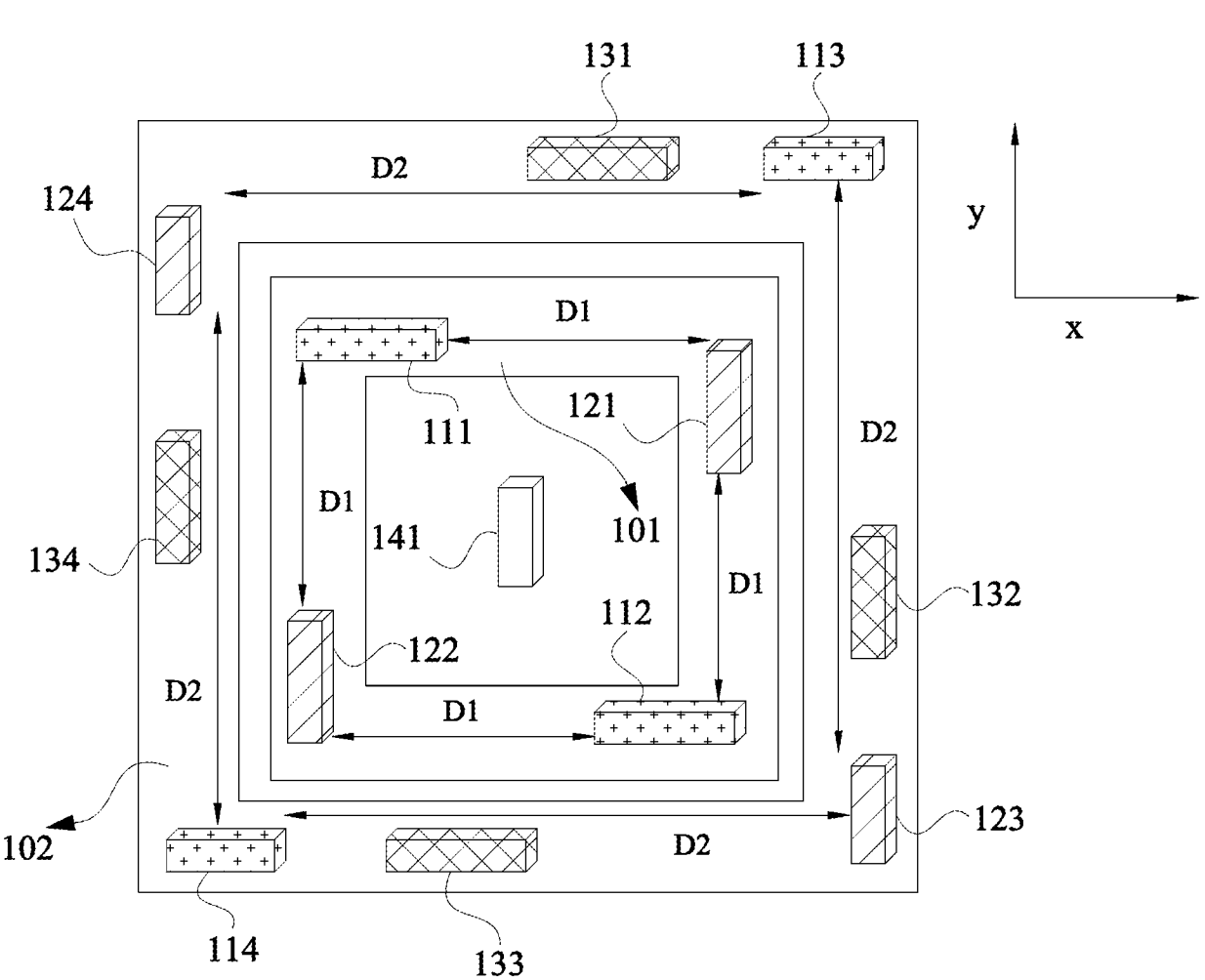
FIG. 1B is a schematic diagram of an antenna system according to another embodiment of the present disclosure.
Figure 1C:
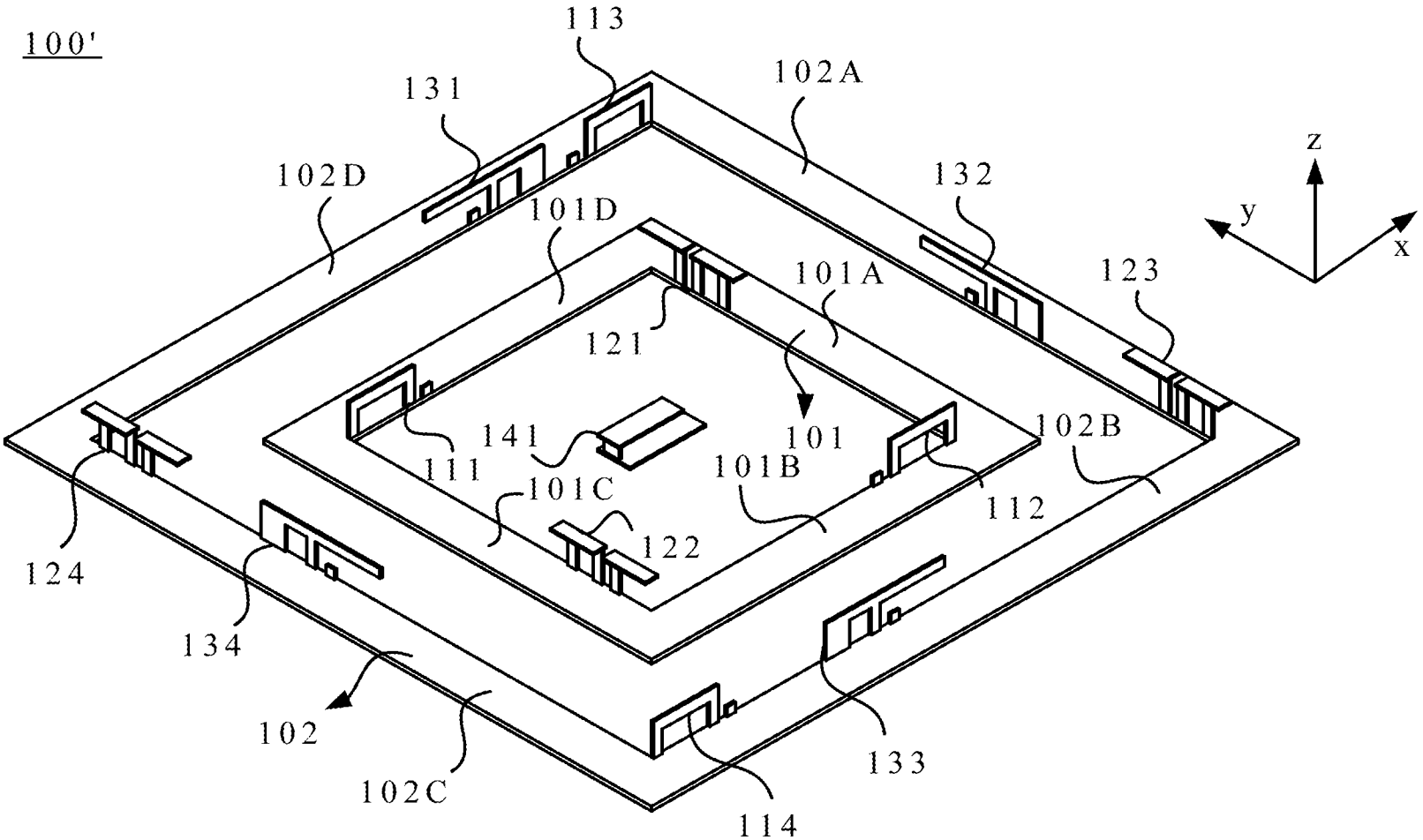
FIG. 1C is a schematic perspective diagram of antenna elements in the antenna system shown in FIG. 1B.

In another embodiment, as shown in FIG. 1B, the antenna system 100' further comprises a fourth antenna element 141 that is disposed in an inner region surrounded by the first support structure 101. The antenna types of the first antenna elements 111-114, the second antenna elements 121-124, the third antenna elements 131-134 and the fourth antenna element 141 are illustrated in FIG. 1C. It is noted that the same antenna types can be also used in the antenna system 100 illustrated in FIG. 1A. In this embodiment, the first antenna elements 111 to 114 are Pi-type antennas, and the second antenna elements 121-124, the third antenna elements 131-134, and the fourth antenna element 141 are inverted-F type antennas. However, the present invention is not limited to these types of antennas.

In addition, according to the arrangement of the antenna elements, the first antenna elements 111 and 112 are respectively disposed on the symmetrical sides of the first support structure 101, and the second antenna elements 121 and 122 are respectively disposed on the other two symmetrical sides of the first support structure 101. Moreover, the first antenna elements 113 and 114 are respectively disposed on the symmetrical sides of the second support structure 102, and the second antenna elements 123 and 124 are respectively disposed on the other two symmetrical sides of the second support structure 102. The third antenna elements 131 to 134 are distributed on the sides of the second support structure 102. In some embodiments, the third antenna elements 131-134, the second antenna elements 123, 124 and the first antenna elements 113, 114 are spaced apart and alternately disposed on the sides of the second support structure 102. As shown in FIG. 1C, the first support structure 101 comprises four sides 101A~101D and the second support structure 102 comprises four sides 102A~102D. The first antenna elements 111 and 112 are respectively disposed on the two symmetrical or nonadjacent sides 101A and 101C. The first antenna elements 113 and 114 are respectively disposed on the two symmetrical sides 102A and 102C. The second antenna elements 121 and 122 are respectively disposed on the two symmetrical sides 101B and 101D. The second antenna elements 123 and 124 are respectively disposed on the two symmetrical sides 102B and 102D. The third antenna elements 131 to 134 are disposed on the sides 102A~102D and spaced from the second antenna elements 123, 124 and the first antenna elements 113, 114. That is, each of the third antenna elements 131 to 134 is alternately disposed between a pair of one of the second antenna elements 121, 122, 123, or 124 and one of the first antenna elements 111, 112, 113, or 114 on the second support structure 102.

In one embodiment, all the first antenna elements 111 to 114 are disposed along a first direction. All the second antenna elements 121 to 124 are disposed along a second direction. Two of the third antenna elements 131 to 134 disposed on the same sides as the first antenna elements 113, 114 along a first direction, and the other two of the third antenna elements 131 to 134 disposed on the same sides with the second antenna elements 123, 124 along a second direction. For example, the third antenna elements 131, 133 are disposed along the first direction, and the third antenna elements 132, 134 are disposed along the second direction. The first direction is perpendicular to the second direction. As shown in FIG. 1A, the first direction, for example, is the x (or −x) direction, and the second direction is the y (or −y) direction. In another embodiment, the first direction and the second direction are the extending directions along the sides of the first support structure 101 or the second support structure 102. The fourth antenna element 141 can be disposed along the first direction, the second direction, or any other direction. The present disclosure is not limited to the direction along which these elements are disposed. Moreover, distances between the first antenna elements 111, 112 and the second antenna elements 121, 122 on the first support structure 101 are a first distance D1. Similarly, distances between the first antenna elements 113, 114 and the second antenna elements 123, 124 on the second support structure 102 are a second distance D2. In some embodiments, the first distance D1 is about 100 mm, and the second distance D2 is about 130 mm.

In one embodiment, the first antenna elements 111 to 114 and the third antenna elements 131 to 134 have a first polarization direction, such as a vertical polarization direction. The second antenna elements 121 to 124 have a second polarization direction, such as a horizontal polarization direction. The fourth antenna element 141 may have the first polarization direction, the second polarization direction or any arbitrary polarization direction. The first polarization direction is perpendicular to the second polarization direction. For example, the first polarization direction may be the +Z (and −Z) direction, and the second polarization direction may be the +y (and −y) direction, or the +x (and −x) direction. It is noted that the above arrangement direction and the polarization direction with respect to the antenna elements are only to demonstrate and are not intended to limit the present invention. In addition, the operating frequency band of the first antenna elements 111-114 and the operating frequency band of the second antenna elements 121 to 124 are the same but different from the operating frequency band of the third antenna elements 131-134. For example, the operating frequency band of the first antenna elements 111-114 and the second antenna elements 121-124 is the 5 GHz wireless band, the operating frequency band of the third antenna elements 131-134 is the 2.4 GHz wireless band supported by Wireless Fidelity, or Wi-Fi. However, the present invention is not limited by the above embodiments. In some embodiments, the operating frequency band of the third antenna elements 131-134 and the operating frequency band of the fourth antenna element 141 are the same.

Figure 2:
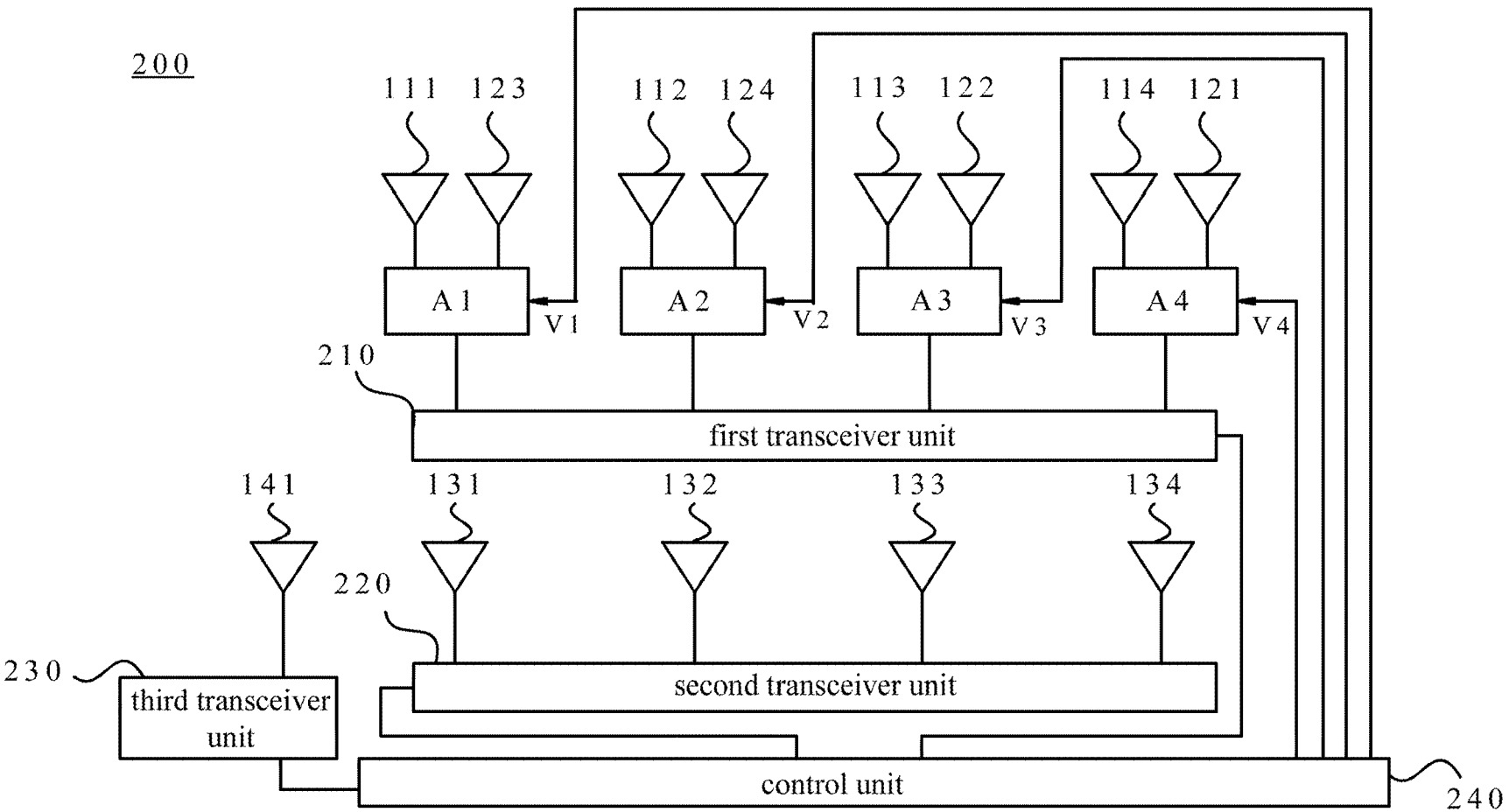
FIG. 2 is a schematic diagram of an antenna system according to an embodiment of the present disclosure.

In one embodiment, the above-described antenna systems 100, 100' can be applied to multi input multi output (MIMO) antenna technology. A 4×4 multiple-input multiple-output antenna and a 2×2 multiple-input multiple-output antenna are used to explain the claimed invention in the following paragraphs. FIG. 2 illustrates a schematic diagram of an antenna system 200 according to an embodiment of the present disclosure. Compared to the antenna system 100', the antenna system 200 further comprises first switches A1~A4, a first transceiver unit 210, a second transceiver unit 220, a third transceiver unit 230 and a control unit 240. The first transceiver unit 210 is electrically coupled to the first switches A1-A4. The second transceiver unit 220 is electrically coupled to the third antenna elements 131-134. The third transceiver unit 230 is electrically coupled to the fourth antenna element 141. The control unit 240 is electrically coupled to the first transceiver unit 210, the second transceiver unit, 220 and the third transceiver unit 230. In this embodiment, the first transceiver unit 210 and the second transceiver unit 220 are coupled to the four groups of input and output, respectively, to receive/transmit wireless signals. Therefore, it can be applied to the 4×4 multiple-input multiple-output antenna.

Each of the first switches A1-A4 is selectively coupled to the at least one of the first antenna elements 111 to 114 and the at least one of the second antenna elements 121-124 to receive/transmit wireless signals. That is, each of the first switches A1-A4 is electrically coupled to one of the first antenna elements and one of the second antenna elements. For example, the first switch A1 is electrically coupled to the first antenna element 111 and the second antenna element 123 to receive/transmit wireless signals through the first antenna element 111 or the second antenna element 123. Similarly, the first switch A2 is electrically coupled to the first antenna element 112 and the second antenna element 124. The first switch A3 is electrically coupled to the first antenna element 113 and the second antenna element 122. The first switch A4 is electrically coupled to the first antenna element 114 and the second antenna element 121. Therefore, each of the first switches A1~A4 may selectively receive/transmit wireless signals through a respective first antenna element and a respective second antenna element.

In addition, the operation frequency band of the first antenna elements 111-114 and the second antenna elements 121-124 is the wireless frequency band of 5 GHz, and the operation frequency band of the third antenna elements 131-134 is the wireless band of 2.4 GHz. Therefore, for different frequency bands of the radio signals, the antenna system 200 has four groups of input and output to receive/transmit wireless signals, so that the antenna system 200 may be applied to the 4×4 multiple input multiple output antenna technology of 5 GHz and 2.4 GHz. In practice, the first antenna elements 111-114, the second antenna elements 121-124, and the third antenna elements 131-134 can be used for general communication transmission. The fourth antenna element 141 may be used in other radio frequency bands to receive/transmit wireless signals, such as satellite positioning auxiliary functions.

The first transceiver unit 210 generates transmission quality parameters corresponding to the received/transmitted radio signals of the first switches A1-A4. Furthermore, the first antenna elements 111-114 and the second antenna elements 121-124 not only are disposed in different positions in the antenna system 100 and 100', but also have different installation directions and polarization directions. Therefore, when the first switches A1-A4 receive/transmit wireless signals through their respective first antenna elements and second antenna elements, the first transceiver unit 210 generates different transmission quality parameters corresponding to the first switches A1-A4. For example, when the first switch A1 receives wireless signals through the first antenna element 111, a signal having a power P111 is generated and transmitted to the first transceiver unit 210. On the other hand, when the first switch A1 receives wireless signals through the second antenna element 123, a signal having a power P123 is generated and transmitted to the first transceiver unit 210. At this time, the first transceiver unit 210 may generate transmission quality parameters corresponding to the powers P111 and P123 respectively. In an embodiment, the transmission quality parameter may be the received signal strength indicator (Received Signal Strength Indicator, RSSI), but the present invention is not limited to such an embodiment. The higher the power signals are, the higher the transmission quality parameters will be. When the power P111 is larger than the power P123, the power transmission quality parameter corresponding to the power P111 will be larger than the power transmission quality parameter corresponding to the power P123.

The control unit 240 generates the control signals V1-V4 to the first switches A1-A4 according to the transmission quality parameters generated by the first transceiver unit 210. Each of the first switches A1-A4 is switched according to the control signals V1-V to couple with one of the first antenna element and the second antenna element. For example, for the first switch A1, if using the first antenna element 111 to receive/transmit wireless signals has a higher transmission quality parameter, the control unit 240 generates a control signal V1 to switch the first switch A1 to couple with the first antenna element 111 to receive/transmit wireless signals. Similarly, the other control signals V2-V4 may also switch the corresponding first switches A2-A4 to couple with the antenna elements having higher transmission quality parameters to receive/transmit wireless signals. Accordingly, in this disclosure, by using a particular configuration method to integrate the antenna elements in the support structure, and by using the switches that are switched according to the transmission quality parameters, each switch corresponding to input and output may have more selective diversity to obtain the best transmission quality in the 4×4 MIMO antenna architecture.

It is noted that the configuration of the first antenna elements and the second antenna elements corresponding to the first switches A1-A4 in the antenna system 200 is not the only possible embodiment. In other embodiments, any two of the first antenna elements 111-114 and the second antenna elements 121-124 can be selected to be configured to each of the first switches A1-A4, or the configuration relationship between the first switches A1-A4 and the first antenna element and the second antenna can be changed depending on the application. For example, the first antenna element 111 and the second antenna element 124 are selected to be electrically coupled to the first switch A1. Alternatively, the first antenna element 111 and the first antenna element 114 are selected to be electrically coupled to the first switch A1. In another alternative embodiment, the second antenna element 123 and the second antenna element 124 are selected to be electrically coupled to the first switch A1. These configurations do not limit the present disclosure.

Figure 3A:
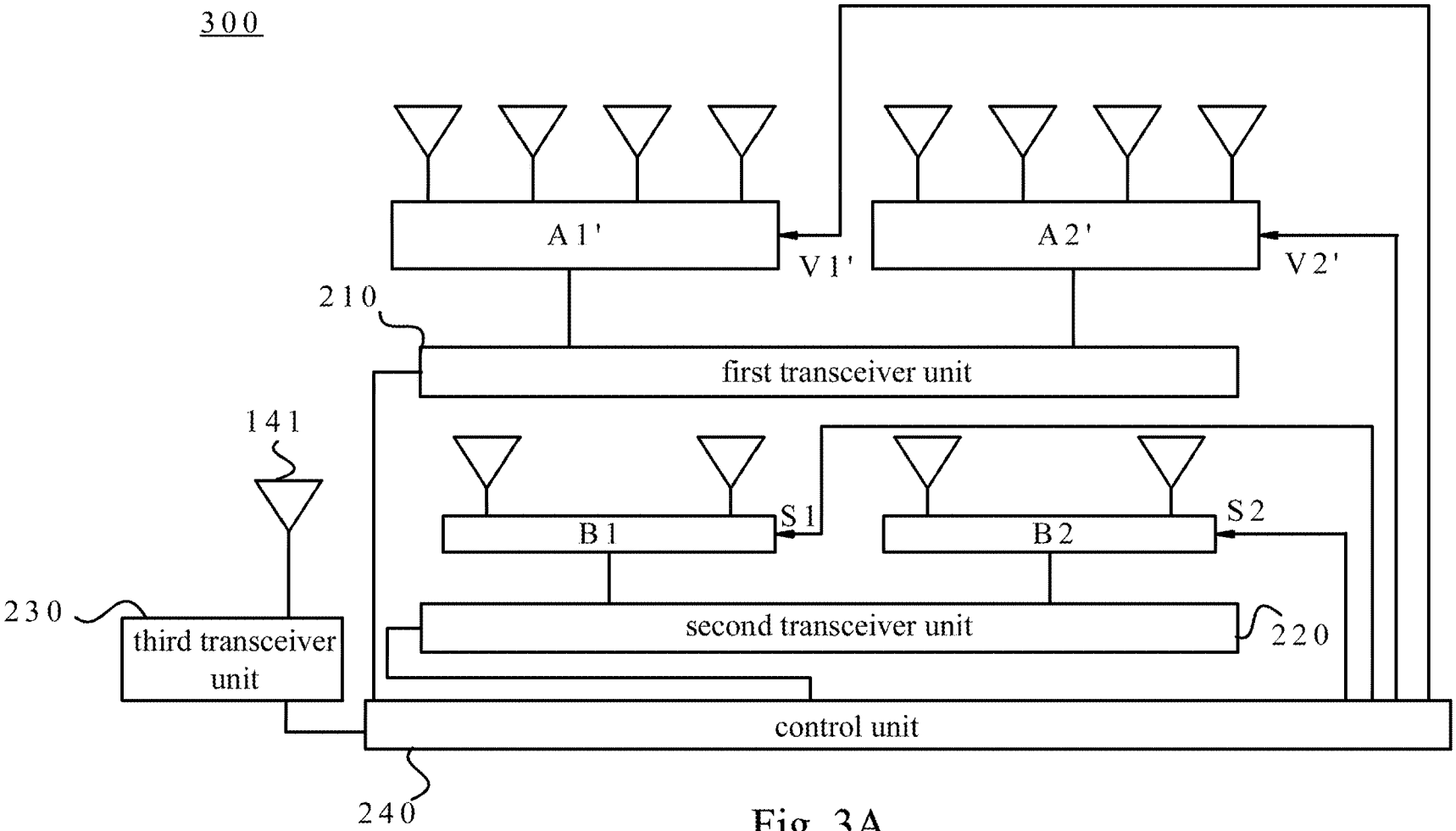
FIG. 3A is a schematic diagram of an antenna system according to an embodiment of the present disclosure.
Figure 3B:
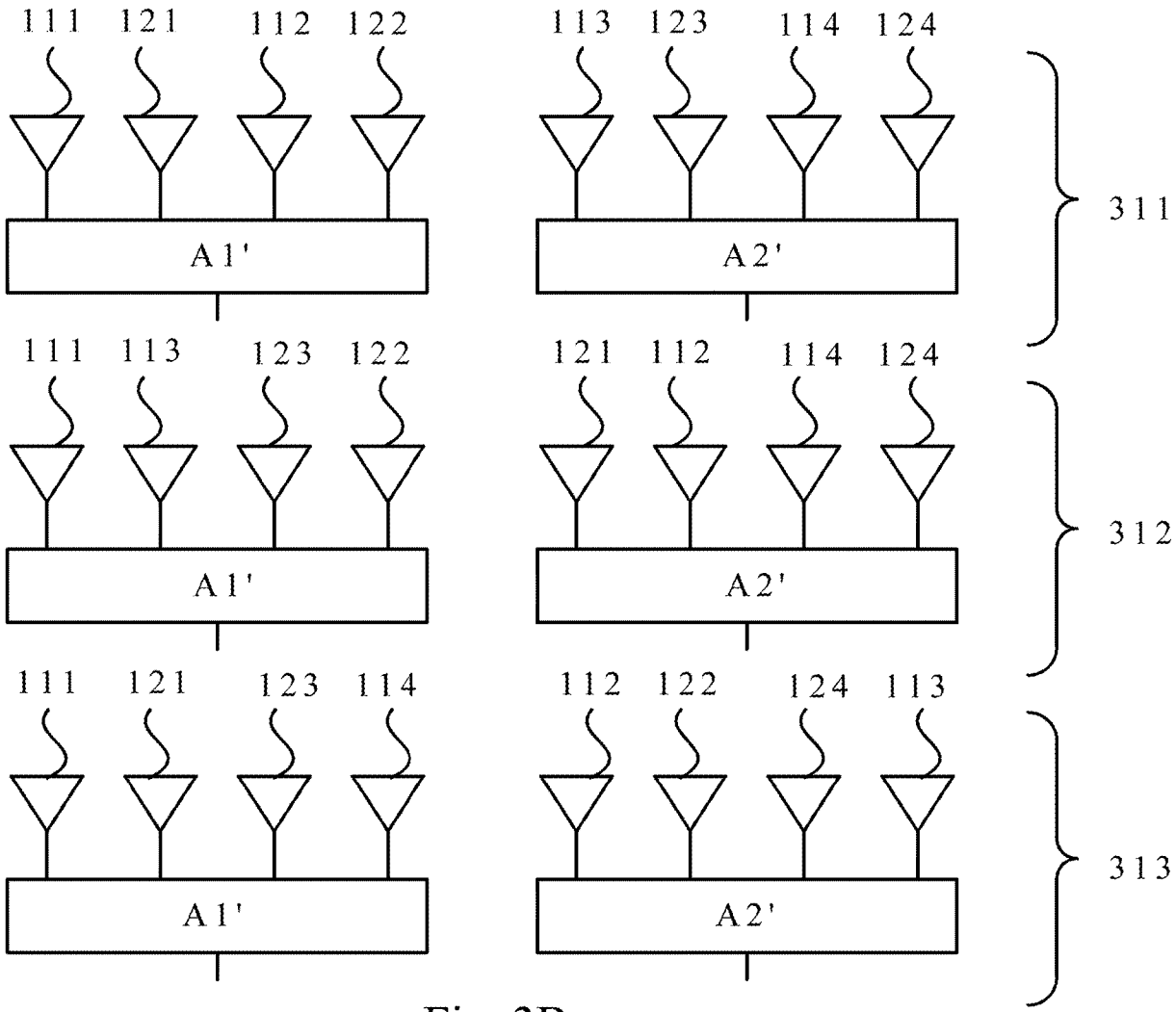
FIG. 3B is a schematic diagram of first switches in FIG. 3A that are electrically coupled to different first antenna elements and second antenna elements.
Figure 3C:
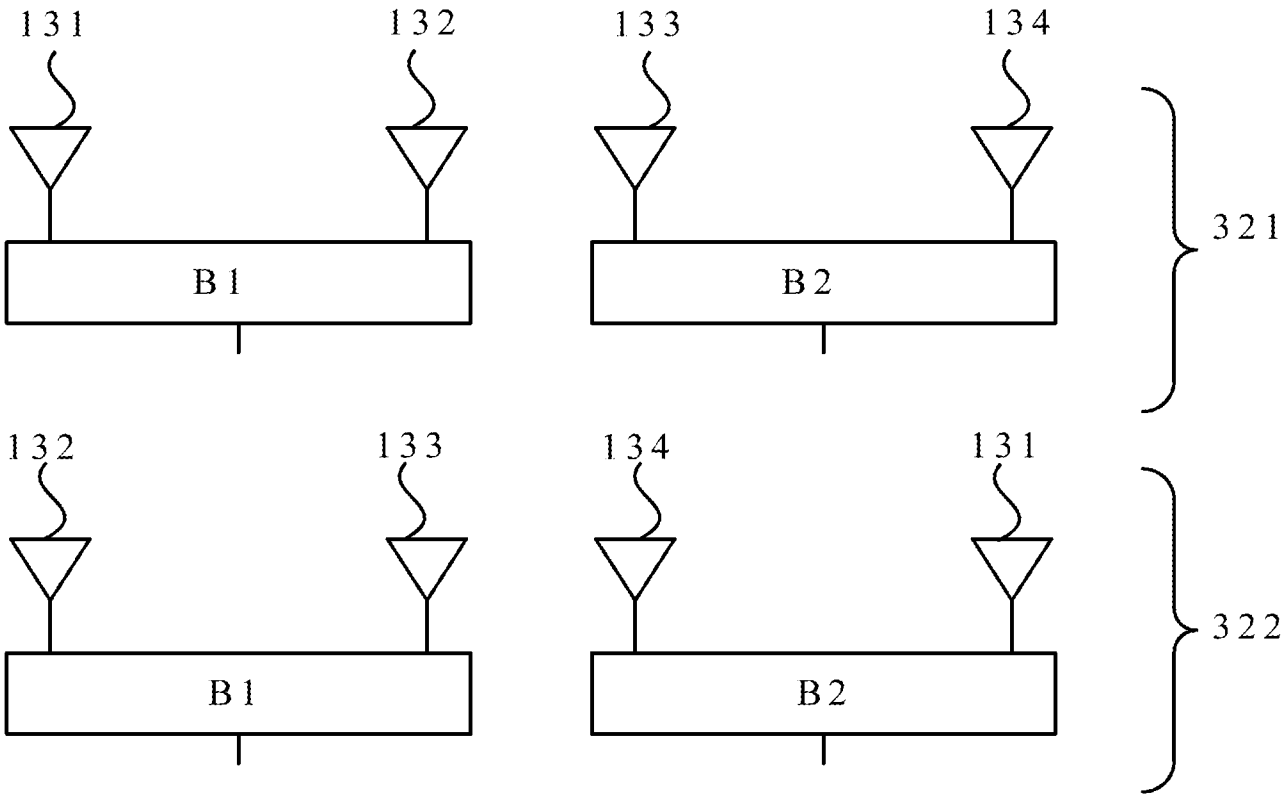
FIG. 3C is a schematic diagram of second switches in FIG. 3A that are electrically coupled to different third antenna elements.

FIG. 3A is a schematic diagram of an antenna system 300 according to an embodiment of the present disclosure. The difference between the antenna system 200 of FIG. 2 and the antenna system 300 of this embodiment is that, in this embodiment, the first transceiver unit 210 and the second transceiver unit 220 of the antenna system 300 are coupled to two pairs of the input and output respectively to receive/transmit wireless signals. That is, the antenna system 300 may be applied to the 5 GHz and 2.4 GHz of 2×2 multiple-input multiple-output antenna technology. The antenna system 300 comprises the first switches A1', A2', the second switches B1, B2, the first transceiver unit 210, the second transceiver unit 220, the third transceiver unit 230 and the control unit 240. The first transceiver unit 210 is electrically coupled to the first switches A1', A2'. The second transceiver unit 220 is electrically coupled to the second switches B1, B2. The third transceiver unit 230 is electrically coupled to the fourth antenna element 141. The control unit 240 is electrically coupled to the first transceiver unit 210, the second transceiver unit 220 and the third transceiver unit 230. Similarly, the first switches A1', A2' and the second switches B1, B2 can be coupled to different antennas for corresponding switching. Other configurations are depicted in FIGS. 3B-3C. FIG. 3B is a schematic diagram of the first switches A1', A2' in FIG. 3A that are electrically coupled to different first antenna elements 111-114 and second antenna elements 121-124. FIG. 3C is a schematic diagram of the second switches B1, B2 in FIG. 3A that are electrically coupled to different third antenna elements 131-134.

As illustrated in FIG. 3B, the configurations 311-313 respectively illustrate the first switches A1', A2' are electrically coupled to different first antenna elements 111-114 and different second antenna elements 121-124. In the configuration 311, the first switch A1' is electrically coupled to the first antenna elements 111, 112 and the second antenna elements 121, 122 to receive/transmit wireless signals through any one of the four antenna elements. The first switch A2' is electrically coupled to the first antenna elements 113, 114 and the second antenna elements 123, 124 to receive/transmit wireless signals through any one of the four antenna elements. In the configuration 312, the first switch A1' is electrically coupled to the first antenna elements 111, 113 and the second antenna elements 122, 123 to receive/transmit wireless signals through any one of the four antenna elements. The first switch A2' is electrically coupled to the first antenna elements 112, 114 and the second antenna elements 121, 124 to receive/transmit wireless signals through any one of the four antenna elements. In the configuration 313, the first switch A1' is electrically coupled to the first antenna elements 111, 114 and the second antenna elements 121, 123 to receive/transmit wireless signals through any one of the four antenna elements. The first switch A2' is electrically coupled to the first antenna elements 112, 113 and the second antenna elements 122, 124 to receive/transmit wireless signals through any one of the four antenna elements.

With the above configuration, the first antenna elements 111-114 and the second antenna elements 121-124 not only are disposed in different positions in the antenna system 100, 100' but also have different disposed directions and different polarization directions. Therefore, as shown in FIG. 3A, when the first switches A1', A2' use the respective first and second antenna elements to receive/transmit wireless signals, the first transceiver unit 210 may generate corresponding transmission quality parameters according to the wireless signals received/transmitted by the first switches A1', A2'. The control unit 240 then generates control signals V1', V2' according to the transmission quality parameters and outputs the same to the first switches A1', A2'. The first switches A1', A2' are switched by the control signals V1', V2' to respectively couple one of the first antenna elements and the second antenna elements. Accordingly, the first switches A1', A2' are controlled to receive/transmit wireless signals through the antenna element having a higher transmission quality parameter.

As illustrated in FIG. 3C, the configurations 321-322 respectively illustrate the second switches B1, B2 are electrically coupled to different third antenna elements 131-134. In the configuration 321, the second switch B1 is electrically coupled to the third antenna elements 131, 132 to receive/transmit wireless signals through any one of the two antenna elements. The second switch B2 is electrically coupled to the third antenna elements 133, 134 to receive/transmit wireless signals through any one of the two antenna elements. In the configuration 322, the second switch B1 is electrically coupled to the third antenna elements 132, 133 to receive/transmit wireless signals through one of the two antenna elements. The second switch B2 is electrically coupled to the third antenna elements 131, 134 to receive/transmit wireless signals through any one of the two antenna elements.

With the above configuration, the third antenna elements 131-134 not only are disposed in different positions in the antenna system 100, 100' but also have different disposed directions and different polarization directions. Therefore, as shown in FIG. 3C, when the second switches B1, B2 use the respective third antenna elements 131-134 to receive/transmit wireless signals, the second transceiver unit 220 may generate corresponding transmission quality parameters according to the wireless signals received/transmitted by the second switches B1, B2. The control unit 240 then generates control signals S1, S2 according to the transmission quality parameters and outputs the same to the second switches B1, B2. The second switches B1, B2 are switched by the control signals S1, S2 to respectively couple one of the third antenna elements. Accordingly, the second switches B1, B2 are controlled to receive/transmit wireless signals through the antenna element having a higher transmission quality parameter.

In conclusion, the antenna system of the present disclosure integrates the antenna elements on a support structure according to a specific arrangement. Moreover, the antenna system further comprises switches that are controlled by the transmission quality parameters so that the input and output corresponding to each switch in the 4×4 or 2×2 multi-input multi-output (MIMO) antenna system have more selective diversity to improve transmission quality.

Even though the present disclosure is disclosed as above, the disclosure is not used to limit the present disclosure. It will be apparent to those skilled in the art that various modifications and variations can be made to the present disclosure without departing from the spirit or scope of the invention; thus, it is intended that the range protected by the present disclosure should refer to the scope of the following claims.

What is claimed is:

1. An antenna system, comprising:

a first support structure;

a second support structure, wherein each of the first support structure and the second support structure has four sides connected to form a closed loop, and the second support structure is disposed outside the first support structure, and surrounds the first support structure;

a plurality of first antenna elements, wherein some of the first antenna elements are disposed on two symmetric sides of the first support structure, and the other of the first antenna elements are disposed on two symmetric sides of the second support structure;

a plurality of second antenna elements, wherein some of the second antenna elements are disposed on another two symmetric sides of the first support structure, and the other of the second antenna elements are disposed on another two symmetric sides of the second support structure;

a plurality of third antenna elements, wherein the third antenna elements are disposed on the four sides of the second support structure;

a plurality of first switches, each of the first switches is selectively coupled to at least one of the first antenna elements or at least one of the second antenna elements for receiving/transmitting wireless signals;

a first transceiver unit electrically coupled to the first switches, wherein the first transceiver unit generates a plurality of transmission quality parameters according to the wireless signal of the first switches; and a control unit electrically coupled to the first transceiver unit, wherein the control unit generates a plurality of control signals and outputs the same to the first switches according to the transmission quality parameters, wherein each of the first switches is switched to couple at least one of the first antenna elements or at least one of the second antenna elements according to the control signals, wherein an operating band of the first antenna elements is the same as an operating band of the second antenna elements, and the operating band of the first antenna elements is different from an operating band of the third antenna elements.

2. The antenna system of claim 1, wherein the first antenna elements have a first polarization direction, and the second antenna elements and the third antenna elements have a second polarization direction, wherein the first polarization direction is perpendicular to the second polarization direction.

3. The antenna system of claim 1, wherein at least one of the first antenna elements and at least one of the second antenna elements selected by each of the first switches are disposed on the first support structure and the second support structure respectively.

4. An antenna system, comprising:

a first support structure;

a second support structure, wherein each of the first support structure and the second support structure has four sides connected to form a closed loop, and the second support structure is disposed outside the first support structure, and surrounds the first support structure;

a plurality of first antenna elements, wherein some of the first antenna elements are disposed on two symmetric sides of the first support structure, and the other of the first antenna elements are disposed on two symmetric sides of the second support structure;

a plurality of second antenna elements, wherein some of the second antenna elements are disposed on another two symmetric sides of the first support structure, and the other of the second antenna elements are disposed on another two symmetric sides of the second support structure;

a plurality of third antenna elements, wherein the third antenna elements are disposed on the four sides of the second support structure;

a plurality of first switches, each of the first switches is selectively coupled to at least two of the first antenna elements or at least two of the second antenna elements for receiving/transmitting a wireless signal;

a first transceiver unit electrically coupled to the first switches, wherein the first transceiver unit generates a plurality of transmission quality parameters according to the wireless signal of the first switches; and a control unit electrically coupled to the first transceiver unit, wherein the control unit generates a plurality of control signals and outputs the same to the first switches according to the transmission quality parameters, wherein each of the first switches is switched to couple at least one of the first antenna elements or at least one of the second antenna elements according to the control signals, wherein an operating band of the first antenna elements is the same as an operating band of the second antenna elements, and the operating band of the first antenna elements is different from an operating band of the third antenna elements.

5. The antenna system of claim 4, wherein at least two of the first antenna elements and at least two of the second antenna elements selected by each of the first switches are disposed together on the first support structure or the second support structure.

6. The antenna system of claim 4, wherein at least two of the first antenna elements and at least two of the second antenna elements selected by each of the first switched are disposed on the first support structure and the second support structure respectively.

7. The antenna system of claim 4, further comprising:

a plurality of second switches, each of the second switches is selectively coupled to at least two of the third antenna elements for receiving/transmitting wireless signals;

a second transceiver unit electrically coupled to the second switches, wherein the second transceiver unit generates a plurality of transmission quality parameters according to the wireless signal of the second switches, and the control unit generates a plurality of control signals and outputs the same to the second switches according to the transmission quality parameters, wherein each of the second switches is switched to couple at least two of the third antenna elements according to the control signals.

8. The antenna system of claim 7, wherein at least two of the third antenna elements selected by each of the second switched are disposed on the adjacent sides of the second support structure respectively.

9. The antenna system of claim 7, wherein at least two of the third antenna elements selected by each of the second switches are disposed on the symmetric sides of the second support structure respectively.

* * * * *